US006059549A

United States Patent [19]

Tarng et al.

[11] Patent Number: 6,059,549

[45] Date of Patent: May 9, 2000

[54] HIGH-LOW PRESSURE CHAMBER SEALING ARRANGEMENT OF A VOLUTE COMPRESSOR

[75] Inventors: Guang-Der Tarng, Hsin Chu Hsien; Lung-Tsai Chang, Hsin Chu, both of Taiwan

[73] Assignee: Rechi Precision Co., Ltd., Tao Yuan Hsien, Taiwan

[21] Appl. No.: 09/047,340

[22] Filed: Mar. 25, 1998

[51] Int. Cl.[7] ..... F01C 1/02

[52] U.S. Cl. ..... 418/55.4

[58] Field of Search ..... 418/55.4

[56] References Cited

U.S. PATENT DOCUMENTS 5,645,408 7/1997 Fujio et al. ..... 418/55.4

FOREIGN PATENT DOCUMENTS 4-121473 4/1992 Japan ..... 418/55.4

5-141201 6/1993 Japan ..... 418/55.4

*Primary Examiner*—Hoang Nguyen

*Attorney, Agent, or Firm*—Rosenberg, Klein & Lee

[57] ABSTRACT

A high-low pressure chamber sealing arrangement of a volute compressor in which a spring element is mounted on a fixed volute at the top, and a seal ring is supported on the spring element and forced upwards by the spring element into close contact with a partition block at the bottom around the through hole on the partition block, which through imparts a passage between a low pressure chamber above the partition block and a high pressure chamber below the partition block.

3 Claims, 5 Drawing Sheets

HIGH-LOW PRESSURE CHAMBER SEALING ARRANGEMENT OF A VOLUTE COMPRESSOR

BACKGROUND OF THE INVENTION

The present invention relates to a volute compressor, and more specifically to the high-low pressure chamber sealing arrangement of a volute compressor.

In a volute compressor, a fixed volute and a rotary volute are meshed together, defining a plurality of compression chambers. The size of each compression chamber gradually reduces from the periphery toward the center. As illustrated in FIGS. 1 and 2, the rotary volute 1 is turned around the fixed volute 2, causing a low pressure working flow of air a to be sucked through a suction hole b into the compression chambers, then compressed in the compression chambers and turned to a high pressure status, and then the high pressure vortex is driven out of an outlet C at the center of the fixed volute 2. FIG. 3 shows a volute compressor according to the prior art. This structure of volute compressor comprises a rotary volute 1 supported on a frame 6, a fixed volute 2, and a partition block 3. The partition block 3 is mounted oil the back side (top side) of the fixed volute 2 around a tubular coupling flange on the fixed volute 2. The partition block 3 has a through hole 4 which receives the tubular coupling flange of the fixed volute 2. A rubber seal ring 5 is mounted around the tubular coupling flange of the fixed volute 2 to seal the gap between the outside wall of the tubular coupling flange of the fixed volute 2 and the periphery of the through hole 4 on the partition block 3. Because the through hole 4 must be accurately aligned with the frame 6, the rotary volute 1 and the fixed volute 2, the precision requirement of the parts of the volute compressor is critical, and the assembly process thereof is complicated. Further, in order to keep the partition block 3 to be stably supported on the fixed volute 2, the tubular coupling flange of the fixed volute 2 as well as the through hole 4 on the partition block 3 must have a certain height (vertical length). Because the through hole 4 on the partition block 3 has a certain height, the partition block 3 cannot be made by stamping. Normally, the partition block 3 is made by forging or die casting. Therefore, the manufacturing cost of the partition block 3 is high.

SUMMARY OF THE INVENTION

The present invention has been accomplished to provide a high-low pressure chamber sealing arrangement for a volute compressor which eliminates the aforesaid drawbacks. According to the present invention, the high-low pressure chamber sealing arrangement comprises a compressor housing defining a holding space; a fixed volute mounted inside the compressor housing, the fixed volute having a spiral blade and a center outlet; a rotary volute mounted inside the compressor housing, the rotary volute having a spiral blade defining with the spiral blade of the fixed volute a plurality of compression chambers, the rotary volute being forced by an external force to revolve around the fixed volute, causing a working flow of air to be sucked into the compression chambers and compressed into a high pressure status and then driven out of the center outlet on the fixed volute; a partition block mounted inside the compressor housing and dividing the holding space of the compressor housing into a high pressure chamber at a bottom side and a low pressure chamber at a top side, the partition block having a through hole in communication between the high pressure chamber and the low pressure chamber; a spring element amounted on the fixed volute at a top side; and a seal ring supported on the spring element and forced upwards by the spring element into close contact with the partition block at a bottom side around the through hole on the partition block. Because the through hole on the partition block is not directly coupled to the fixed volute, the precision requirement of the parts of the volute compressor is less critical, the height of the through hole on the partition block can be minimized, allowing the partition block to be made by stamping.

DETAILED DESCRIPTION OF THE PREFERRED EMBODIMENT

Figure 1:
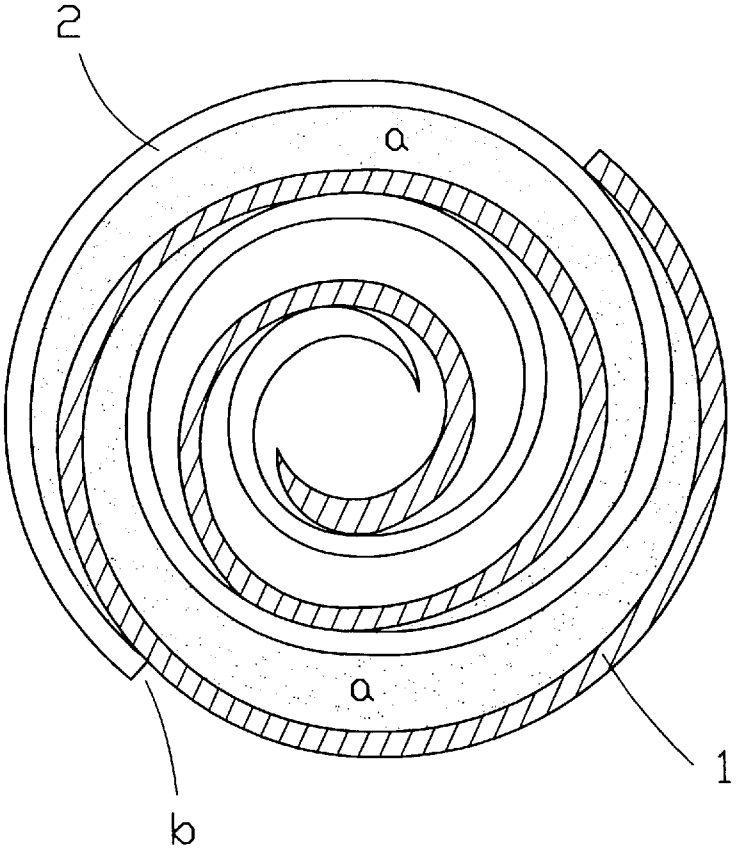
FIG.1 PRIOR ART
FIG. 1 is a schematic drawing explaining the operation of a volute compressor according to the prior art (step I).
Figure 2:
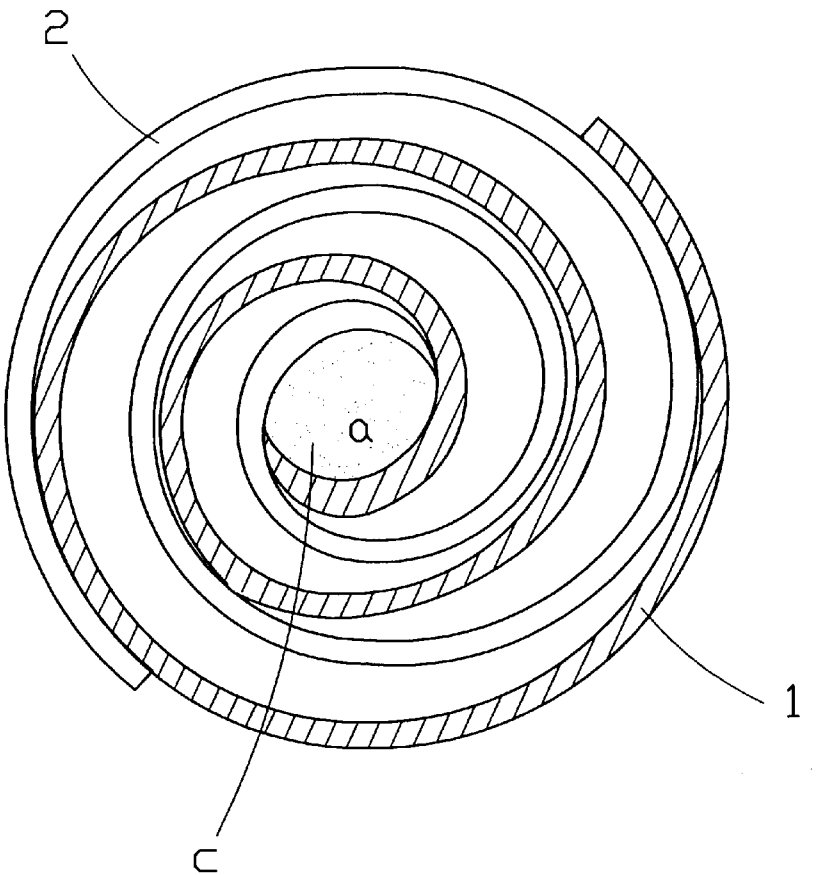
FIG.2 PRIOR ART
FIG. 2 is a schematic drawing explaining the operation of a volute compressor according to the prior art (step II).
Figure 3:
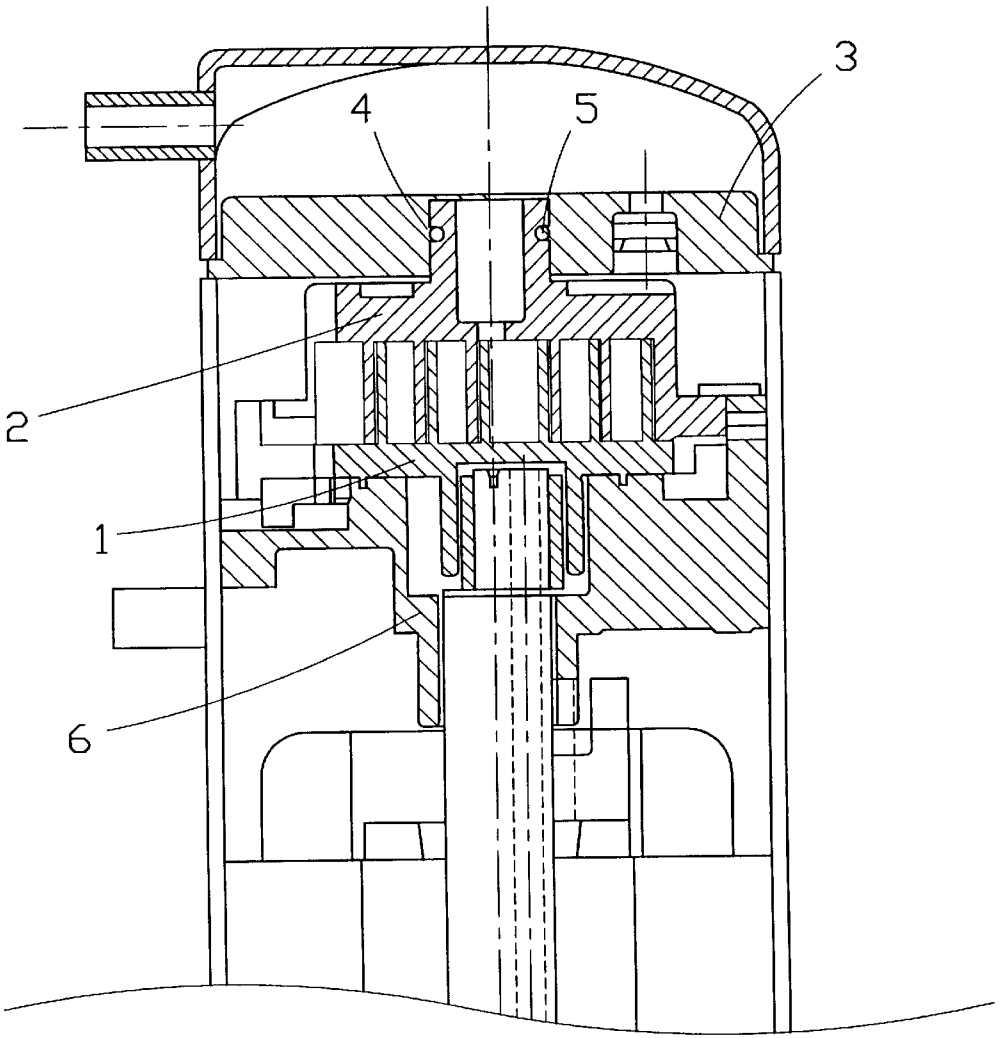
FIG.3 PRIOR ART
FIG. 3 is a plain view of a volute compressor according to the prior art.
Figure 4:
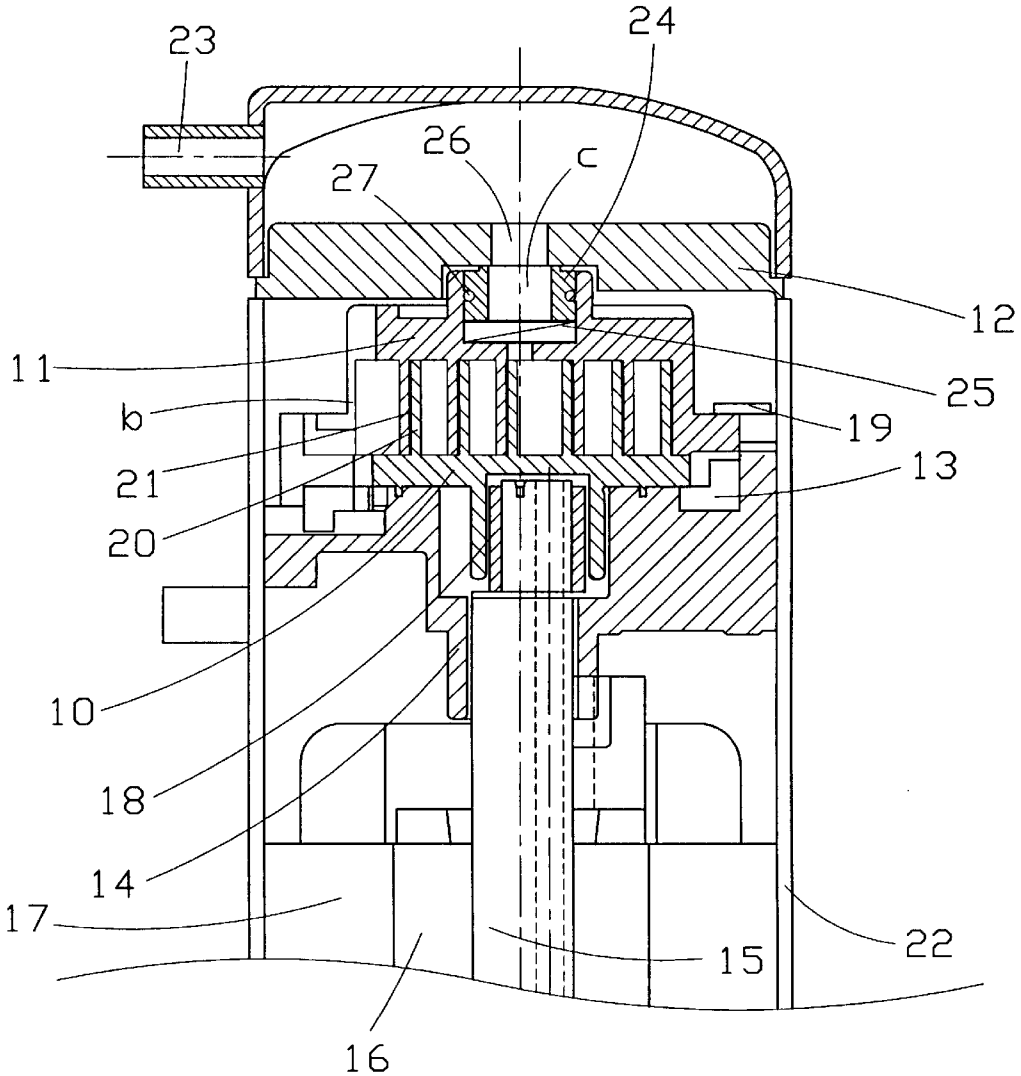
FIG. 4 is a plain view of a volute compressor according to the present invention.
Figure 5:
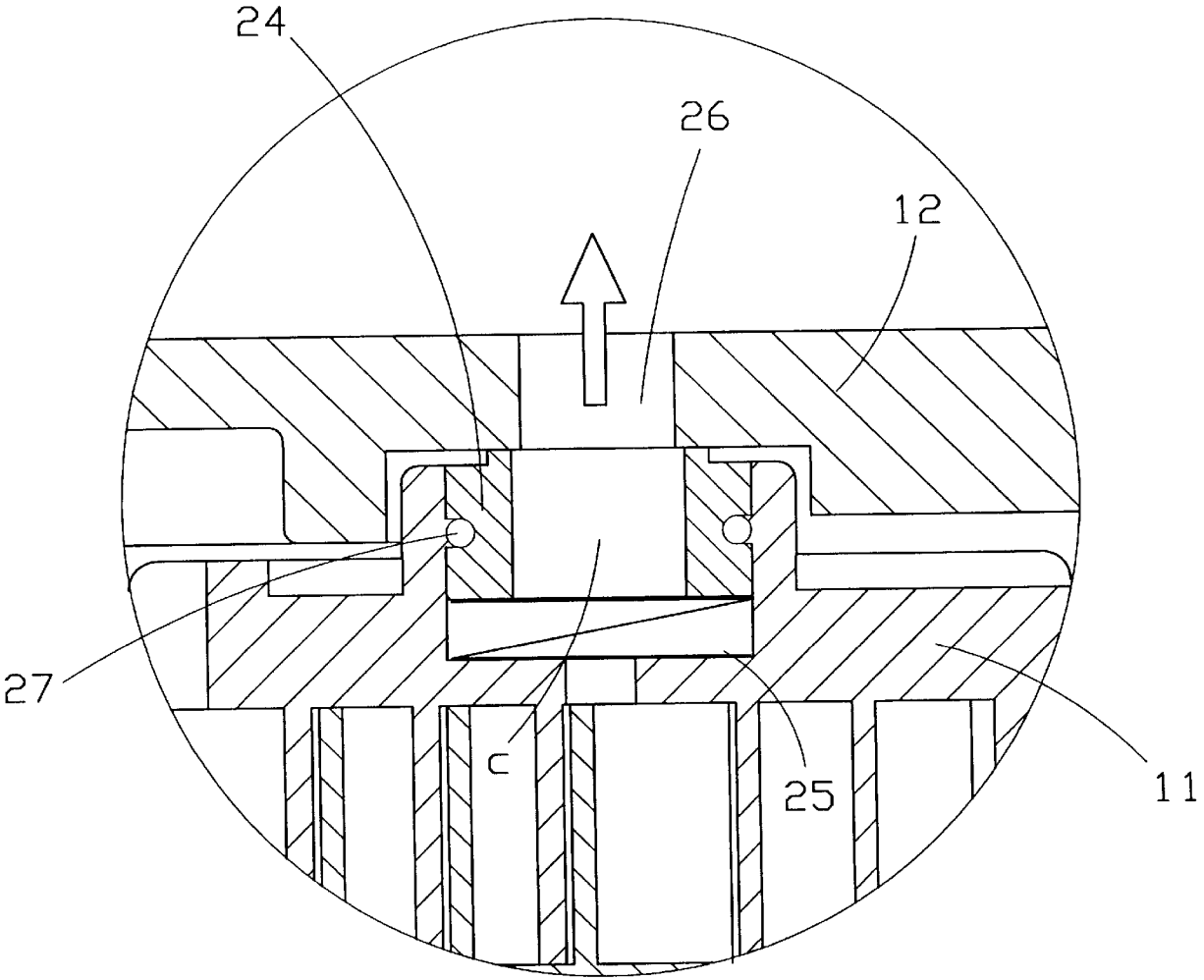
FIG. 5 is an enlarged scale of a part of FIG. 4, showing the metal seal ring retained between the partition block and the spring element.

Referring to FIGS. 4 and 5, a volute (compressor is shown comprised of a rotary volute 10, a fixed volute 11, a partition block 12, a ring 13, a frame 14, an eccentric shaft 15, a rotor 16 and a stator 17. The eccentric shaft 15 is fixedly connected to the rotor 16 at the center. A coupling sleeve 18 is mounted around the eccentric shaft 15 at the top. When the stator 16 is started, the eccentric shaft 15 is rotated, thereby causing the rotary volute 10 to be turned with the coupling sleeve 18 eccentrically about the longitudinal central axis of the rotor 16. The ring 13 is mounted on the frame 14 at the top. When the rotary volute 10 is driven by an external force, the rotary volute 10 is controlled by the ring 13 to revolve around the fixed volute 11, and prohibited from revolving on its own axis. The rotary volute 10 is held down by the fixed volute 11 on the frame 14. The fixed volute 11 is secured to the frame 14 by a stop plate 19, the stop plate 19 allows the fixed volute 11 to be moved axially within a limited range. Spiral blades 20;21 of the rotary volute 11 and the fixed volute 11 are arranged together, defining a plurality of compression chambers. The partition block 12 is fixedly mounted inside the housing 22 of the volute compressor, separating the holding space of the housing 22 into a high pressure chamber and a low pressure chamber. The partition block 12 has a center through hole 26 which imparts a passage between the high pressure chamber and the low pressure chamber. When a low pressure working flow of air is sucked into the compression chambers inside the housing 22 through a suction hole b, it is turned round and round by the rotary volute 20 and propelled out of an outlet c at the center of the fixed volute 11 and then driven out of the housing 22 through an outlet pipe 23.

A metal seal ring 24 and a spring element 25 are arranged at the top of the outlet c. The metal seal ring 24 is supported on the spring element 25, and forced by the spring element 25 into contact with the bottom side of the partition block 12 around the center through hole 26. A packing member 27 is mounted around the metal seal ring 24. When the volute compressor begins to work, the space above the metal seal ring 24 as well as the space below the metal seal ring 24 are at a low pressure status, and the metal seal ring 24 is forced upwards by the spring force of the spring element 25, enabling a high pressure to be set up in the high pressure chamber below the metal seal ring 24 (partition block 12). When a high pressure is set up, an upward pressure is given by the high pressure to the metal seal ring 24, causing the metal seal ring 24 to be firmly retained in close contact with the bottom side of the partition block 12.

Because of the arrangement of the metal seal ring 24 and the spring element 25, it is not imperative to vertically align the center through hole 26 of the partition block 12 with the center of the fixed volute 11 and the frame 14. Because precision requirement is less critical, the manufacturing cost of the parts of the volute compressor is low, and the assembly process thereof is simple.

While only one embodiment of the present invention has been shown and described, it will be understood that various modifications and changes could be made thereunto without departing from the spirit and scope of the invention disclosed.

What the invention claimed is:

1. A high-low pressure chamber sealing arrangement comprising:

a compressor housing defining a holding space;

a fixed volute mounted inside said compressor housing, said fixed volute having a spiral blade and a center outlet;

a rotary volute mounted inside said compressor housing, said rotary volute having a spiral blade defining with the spiral blade of said fixed volute a plurality of compression chambers, said rotary volute being forced by an external force to revolve around said fixed volute, causing a working flow of air to be sucked into said compression chambers and compressed into a high pressure status and then driven out of the center outlet on said fixed volute;

a partition block mounted inside said compressor housing and dividing the holding space of said compressor housing into a high pressure chamber at a bottom side and a low pressure chamber at a top side, said partition block having a through hole in communication between said high pressure chamber and said low pressure chamber; wherein:

a spring element is mounted on said fixed volute at a top side, and a seal ring is supported on said springy element and forced upwards by said spring element into close contact with said partition block at a bottom side around the through hole on said partition block.

2. The high-low pressure chamber sealing arrangement of claim 1, wherein said seal ring is made from metal.

3. The high-low pressure chamber sealing arrangement of claim 1, wherein said seal ring is peripherally packed with a packing member.

* * * * *